US007494419B2

(12) United States Patent
Katz et al.

(10) Patent No.: US 7,494,419 B2
(45) Date of Patent: Feb. 24, 2009

(54) INDOOR STAIR SLIDE FOR TRANSPORTING THE HANDICAPPED BETWEEN FLOORS AND/OR FOR JOYFUL RIDES

(76) Inventors: Dov Katz, 12 Harrison Ave., Apt 2B, Brooklyn, NY (US) 11211; Bezalel Katz, 12 Harrison Ave., Apt. #2B, Brooklyn, NY (US) 11211

( * ) Notice: Subject to any disclaimer, the term of this patent is extended or adjusted under 35 U.S.C. 154(b) by 320 days.

(21) Appl. No.: 11/330,680

(22) Filed: Jan. 11, 2006

(65) Prior Publication Data

US 2007/0161460 A1 Jul. 12, 2007

(51) Int. Cl.
*A63G 21/20* (2006.01)

(52) U.S. Cl. ..... 472/116; 472/134; 182/48

(58) Field of Classification Search ..... 472/116–117, 472/128, 129, 134; 182/48, 49
See application file for complete search history.

(56) References Cited

U.S. PATENT DOCUMENTS 3,743,281 A * 7/1973 Gimbel ..... 472/116
3,973,645 A 8/1976 Dix et al.
4,526,262 A 7/1985 Malcolm
4,805,898 A 2/1989 Jacober et al.
4,813,663 A 3/1989 Rice
5,197,924 A 3/1993 Gerrells
5,427,574 A 6/1995 Donnelly-Weide
D362,291 S 9/1995 Franco
5,975,467 A * 11/1999 O'Donnell et al. ..... 244/137.2
6,142,879 A * 11/2000 Phillips ..... 472/116
6,193,633 B1 2/2001 Jonas et al.
6,321,770 B1 11/2001 Hintzman et al.
6,322,454 B1 11/2001 Gordon
6,406,377 B1 6/2002 Demko
6,471,001 B1 * 10/2002 Baker et al. ..... 182/48
6,536,715 B1 3/2003 Moran et al.
6,648,767 B1 11/2003 Chen
6,650,246 B2 * 11/2003 Field et al. ..... 340/657
6,695,096 B2 * 2/2004 Idler et al. ..... 182/48
6,761,337 B2 7/2004 Baderspach et al.
6,799,741 B2 10/2004 Danielson et al.

* cited by examiner

*Primary Examiner*—Kien Nguyen
(74) *Attorney, Agent, or Firm*—Ostrolenk, Faber, Gerb & Soffen, LLP

(57) ABSTRACT

A stair slide having a longitudinally extending inflatable body with an upper surface and a lower surface. The body is configured so that when inflated, the lower surface conforms to steps of a stairway and the upper surface is substantially flat. A mounting device is attached to an upper end of the body for securing the body at the stairway. A lower end of the body opposite the upper end is formed as a flat landing area.

19 Claims, 6 Drawing Sheets

INDOOR STAIR SLIDE FOR TRANSPORTING THE HANDICAPPED BETWEEN FLOORS AND/OR FOR JOYFUL RIDES

BACKGROUND OF THE INVENTION

The present invention relates to an in-home or indoor slide for transporting handicapped persons between floors over steps or for children to enjoy.

Slides for children are generally found outdoors in schoolyards and playgrounds. As is well known, children find slides to be a fun filled activity. Unfortunately, such slides can only be used when the weather outside is favorable.

Thus, it is desirable to provide a slide apparatus that can be used indoors for a variety of purposes. Various devices have been developed for sliding down stairways. Some of these are described in U.S. Pat. Nos. 4,813,663; 5,197,924; 5,427,574; and U.S. Design Pat. No. 362,291.

There are also numerous patents on outdoor slides as well as non-entertainment slides such as inflatable evacuation slides for use with, for example, aircraft.

Although the above listed patents provide constructions which in theory are usable indoors to provide a slide, the problem with these devices is that they must remain in place on the stairway when not in use or, if they are removable, they present a very large and heavy construction that is difficult to move and store conveniently and quickly.

SUMMARY OF THE INVENTION

Accordingly, it is an object of the present invention to provide an indoor stair slide that is easy to assemble and disassemble, including by the ultimate home user.

Furthermore, it is an object of the invention to provide an in-home stair slide that when disassembled, forms a relatively small and light package or packages which can easily be stored.

It is also an object of the present invention to provide an in-home stair slide that can be used to move disabled persons up or down staircases.

Another object of the invention is to provide an in-home inflatable stair slide that is usable by children.

Pursuant to these objects, and others which will become apparent hereafter, one aspect of the present invention resides in a stair slide that is inflatable to a shape in which the top surface of the slide is flat and the bottom surface of the slide conforms to the steps of the stairway. A mounting device is attached to the upper end of the slide for securing the slide to a stairway or to a nearby staircase wall, doorpost, etc. A lower end of the slide opposite the upper end is formed as a flat, protected landing area.

In another embodiment of the invention, a pump is connected to the slide for inflation. The pump can be connected by a conduit or conduits to a plurality of air inlets in the slide. A pressure sensor can be provided so as to sense air pressure in the slide. A pressure sensor is connected to the pump so as to activate the pump when the air pressure falls below a predetermined level and stop the pump when the air pressure reaches a predetermined level.

In another embodiment of the invention, the pump is usable to rapidly deflate the inflatable stair slide for quick folding and stowing away.

In another embodiment of the invention, a number of small pin-holes are provided in the upper surface of the slide to create an air cushion for a person sliding down the slide, the pump maintaining air pressure.

In yet another embodiment of the invention, the pump is remotely actuable by a hand-held remote control so that the pump may be turned on and off from a remote location.

In a further embodiment, a sliding chair or cushion for a disabled person is configured to slide up and down the slide using the motive force of a winching mechanism that is secured at the top of the staircase and has a winching rope or ropes attached to the chair.

Other features and advantages of the present invention will become apparent from the following description of the invention that refers to the accompanying drawings.

DETAILED DESCRIPTION OF EMBODIMENTS OF THE INVENTION

Figure 1:
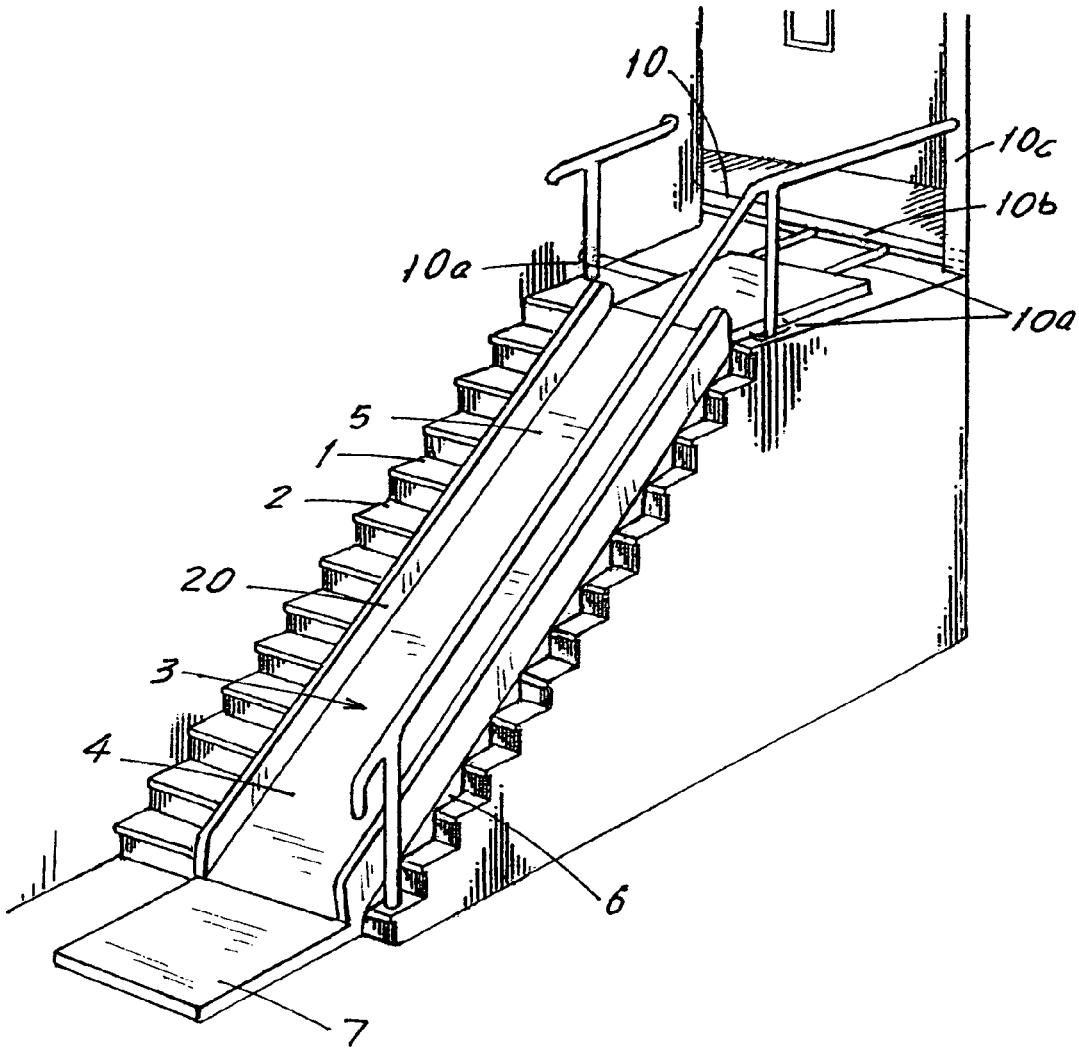
FIG. 1 is a perspective of the inventive inflatable stair slide arranged on a stairway.

FIG. 1 schematically shows the side view of a stairway 1 having a number of steps 2. The inventive slide 3 has a longitudinally extending inflatable body 4. The body can be made of any suitable material such as vinyl or rubber. The body 4 has a smooth, generally flat upper section with a surface 5 along which a user can slide when the body 4 is inflated, preferably protected by inflatable sidewalls 20 to prevent bumping into the walls or steps of the staircase. The body 4 also has a lower section 6 with a stepped configuration whereby the lower section supports the upper section 5 on the steps 2 of the stairway 1 when the body 4 is inflated.

Figure 2:
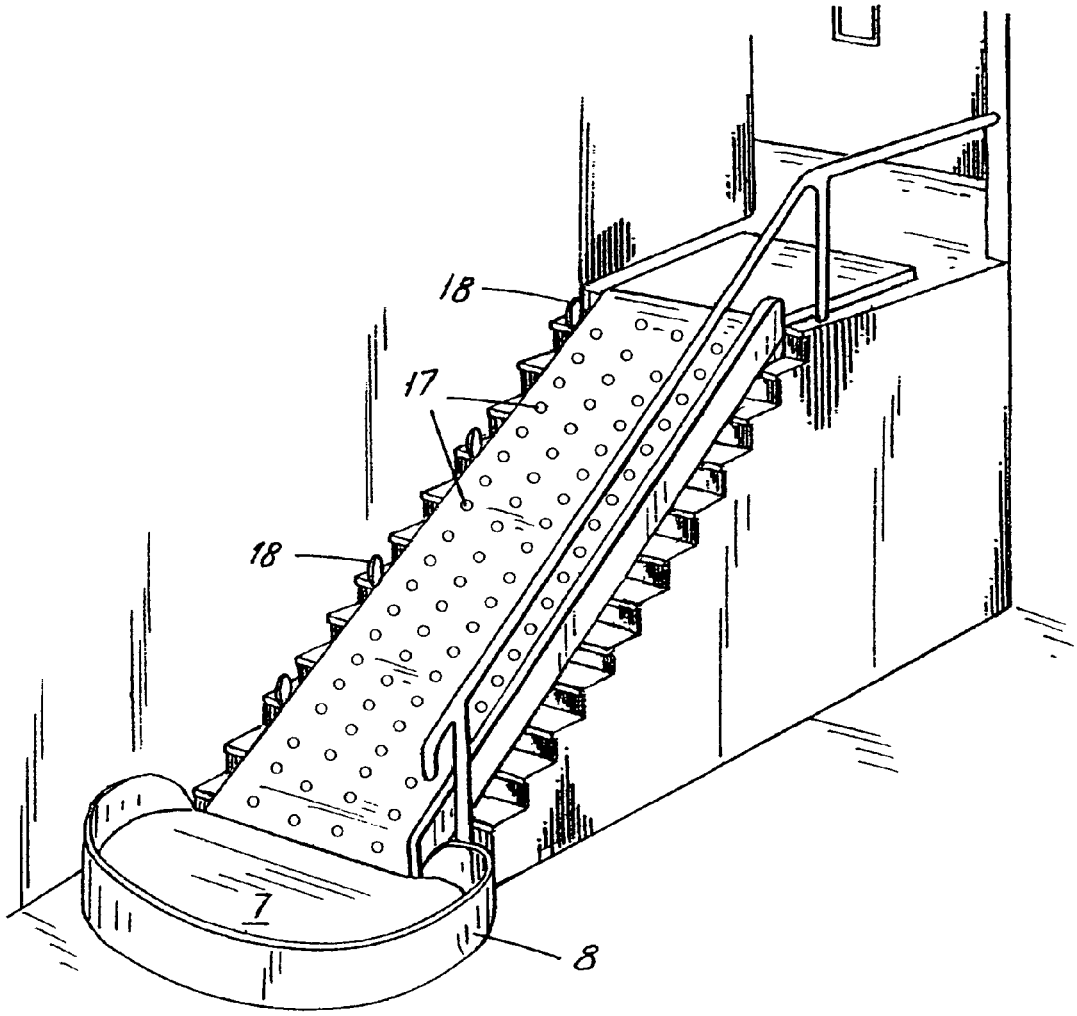
FIG. 2 is a perspective of a second embodiment of the inflatable slide.
Figure 3:
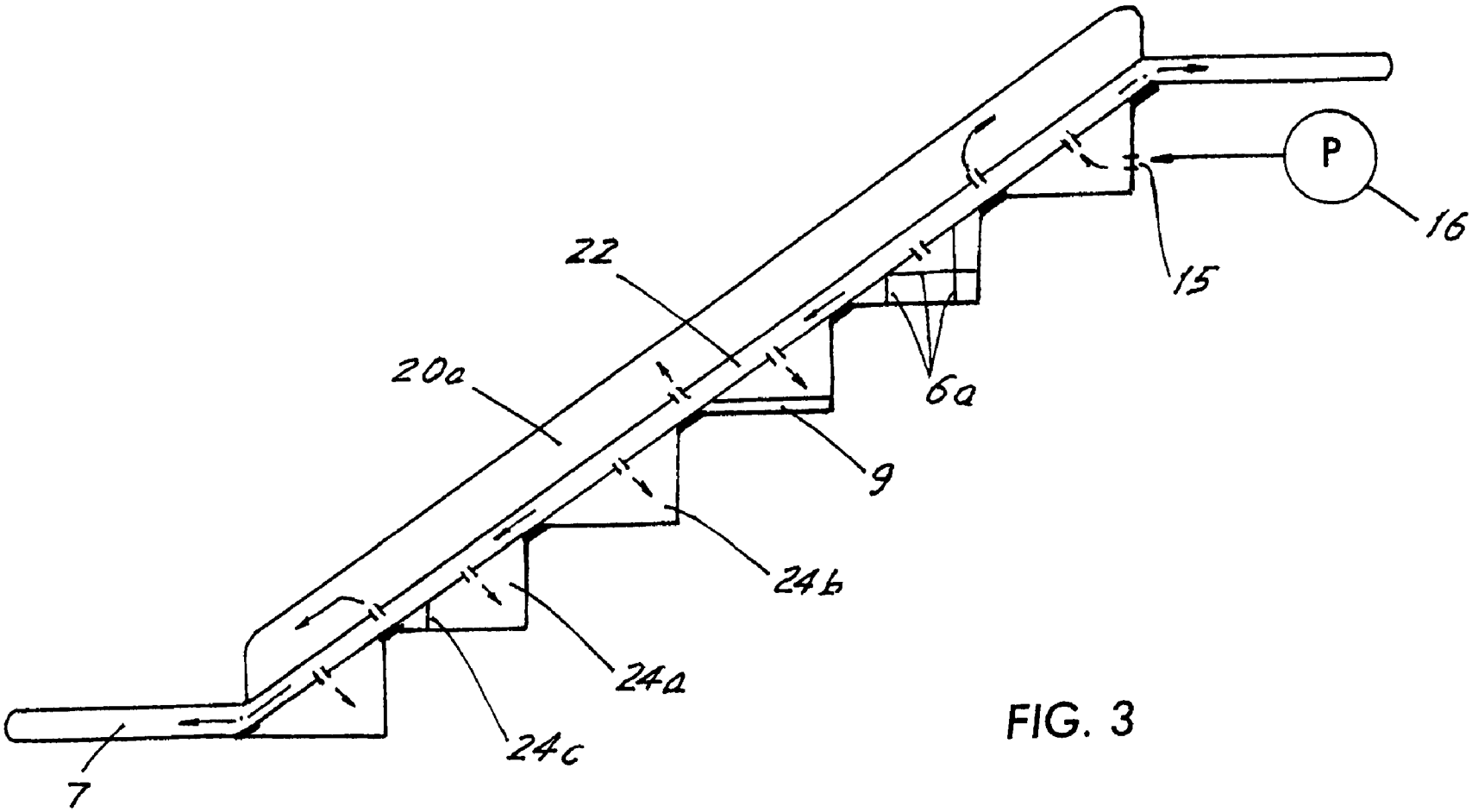
FIG. 3 is a cross-section through the slide of FIG. 1.

At the bottom of the body 4 is a landing portion 7, with an optional inflatable protective wall 8 (FIG. 2) which preferably encloses the landing area 7. The body 4 can be made up of a single chamber or a plurality of inflatable chambers that are sealed from one another to improve structural rigidity and enable continued use even if one of the chambers has sprung a leak. The chambers can include a sliding chamber 22 (or several such chambers), step chambers 24*a*, 24*b*, etc., expansion chambers 9, a landing chamber 7*a*, side wall chambers, and so on. See FIG. 3.

The interiors of the various chambers may include internally secured straps 6*a*, extending between opposed wall surfaces. The straps 6*a* are made of non-stretchable, thin material, e.g., lightweight cloth, and serve the purpose of defining the ultimate shape of the slide when fully inflated and preventing any weaker section from over-expanding, without meaningfully increasing the weight of the stowed, deflated slide.

As previously stated, the bottom section of the slide 3 is configured to provide supports that rest on the steps when the slide is inflated. Since steps are not always uniform in height, one or more of the horizontal portions of the lower surface 6 of the slide can be provided with separate expansion inflatable expansion chambers 9 which can be inflated to fill a gap between the lower surface 6 and the top of a step. Further, step chambers 24*a*, 24*b* may be longitudinally shorter than the steps and end at vertical surface 24*c*.

The upper end of the slide 3 is provided with an arrangement 10 (FIG. 1) for supporting the slide at the top of the stairway. The supporting structure 10 can have various constructions. For example, in a simple form, ropes 10*a* could be provided that are attached to grommets at the top end of the slide and the ropes are then tied off, for example, to the railing or a heavy piece of furniture at the top of the stair or to U-shaped brackets (not shown) that can be fastened securely to grip the door posts at the top of the staircase. Alternatively, the mounting arrangement 10 can be a bar 10*b* attached to the upper end of the slide and having a length so that the bar engages behind a railing or the staircase doorposts 10*c* to support the slide. Various other types of support arrangements can also be used and are all intended to fall within the present invention even if not specifically described here.

The slide may be as wide as the staircase. But, as shown in FIG. 1, the slide may have a width so as to leave a portion of the stairway exposed to allow users to climb up the steps 2.

Figure 4:
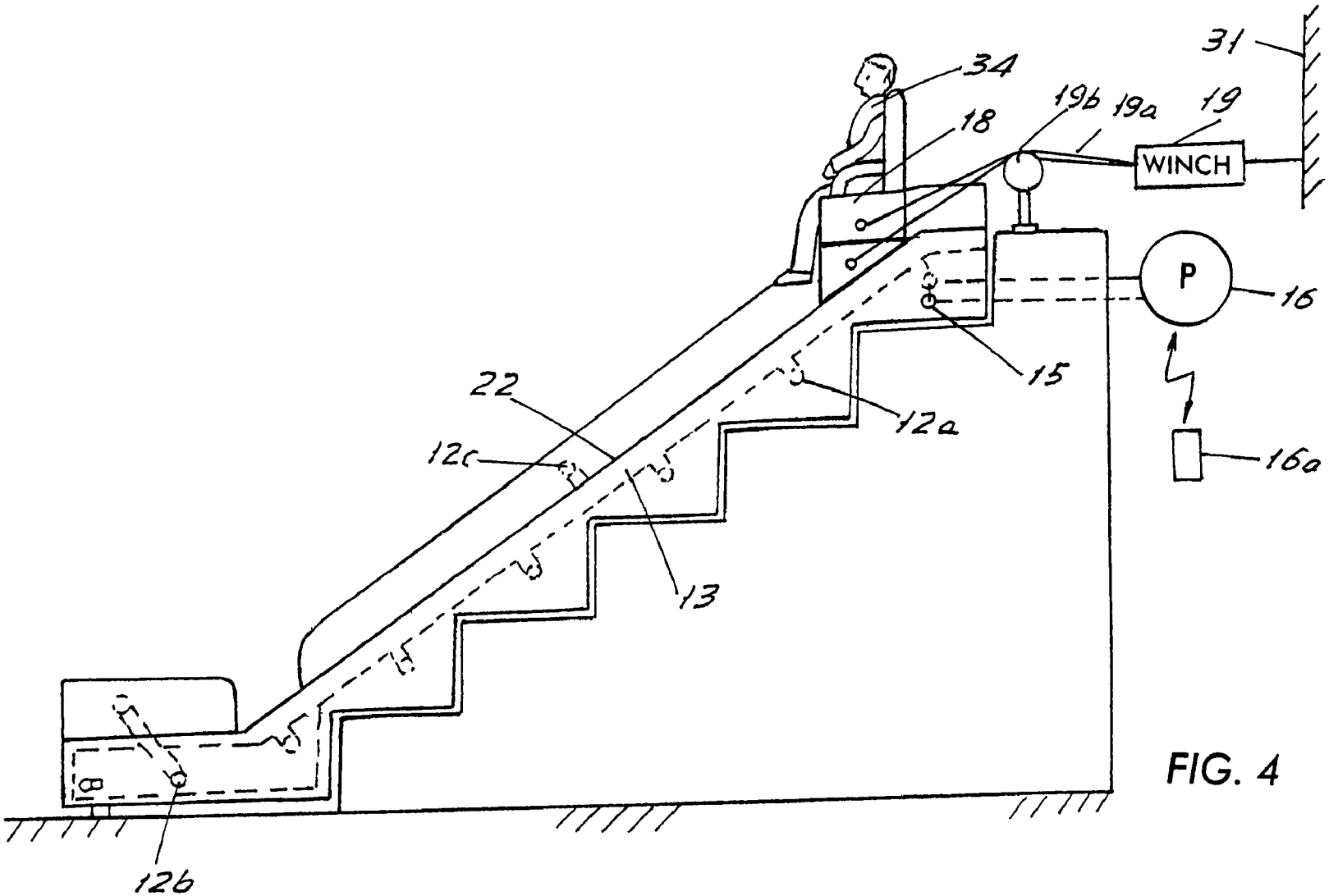
FIG. 4 is a side view of the chair slide arranged on a stairway and configured to transport a disabled person, including a winching system.

The slide 3 can be inflated in a number of different ways. The simplest manner is by providing at least one closeable inlet 15 (FIG. 3) through which air can be provided by either manual blowing or a pump 16. In another embodiment (FIG. 4), pump 16 and manifold system 13 is provided. In this embodiment, many of the steps have an air inlet 12 that is connected to a manifold 13 which is in turn connected to the pump 16. The manifold 13 can be made of a flexible tubing. Alternatively, the manifold may be incorporated within the outermost stair of the slide or may be located along the bottom surface of the slide. When the pump is actuated, air passes through the manifold 13 into the inlets 12 to inflate the slide 3. The manifold preferably includes air conduits for the slide body 22 via an inlet 12*a*, for the landing 7 via inlet 12*b*, for the sidewalls via inlet 12*c*, and so on. Once an appropriate pressure is achieved in the slide to properly inflate the slide, the pump 16 can be turned off.

It is also possible to provide a pressure sensor 15 at one or more of the inlets. This pressure sensor can be electrically connected to the pump 16 so as to turn the pump off when a specific pressure is present in the slide and also to turn the pump on if the pressure in the slide falls below a specified level.

For deflating the slide, it is possible to reverse the pump which will cause the air in the slide to be sucked out via the openings 12, 12*a*, 12*b*, etc. and the manifold 13, to allow the entire slide 3 to be quickly folded up into a very small package. An alternative would be to simply disconnect the manifold 13 from the openings 12 to let the air in the slide to escape. The manifold 13 can be connected by conventional quick-connect couplings. When deflated, the body can be folded or rolled up into a small package that is easily storable, for example, in a closet.

It is also desirable to allow the pump to be remote controlled so that a user of the slide or someone else, e.g., the owner, can control inflation of the slide via remote control 16*a*.

When using a pump attached by a manifold to the slide for inflation purposes, it is possible to provide a plurality of small pin-holes 17 (shown in exaggerated size in FIG. 2) in the upper surface 5 so that a small quantity of air can escape from the slide to create an air cushion which will provide less friction to a person or a chair or cushion (to be described) sliding down or up the slide.

If the width of the slide is substantially equal to the width of the steps (FIG. 2) so that it is not possible to walk up the steps next to the slide, straps or handles 18 are mounted to the slide so that the handles can be grasped by a child to assist in climbing up the slide from bottom to top. The strap 18 can be of any desired material suitable for the purpose. The slide is provided with reinforcement in the areas where the handle 18 are attached so as to prevent tearing or damage to the slide when the handles are used for climbing. Such straps may also be provided at the sides and used to tie the slide to a stair railing for increased support of the slide.

The slide 3 can be used as is to slide down various heavy objects, weighing as much as two or three hundred pounds or more, or for the enjoyment and entertainment of children. However, by providing a winch mechanism 19 (FIG. 4) and a seat 18 with a harness 34, it is possible to utilize the slide as a means for invalids or disabled persons to travel up and down a stairway, they normally would not be able to negotiate. The present invention is thus an inexpensive alternative to costly in-home elevators and stairway elevators, that must be professionally installed. The winch system 19 can be anchored or secured to the floor or the door posts or railing or wall at the top of the staircase by any of the widely known means and implements to secure structures to immovable objects, e.g., bolts, screws, ropes, brackets, etc. For example, the main winch 19 may be secured to a wall 31 with winching ropes 19*a* guided and supported on rotatable stand 19*b* being attached to the chair 18 to pull up or allow the chair 18 to slide down. The ropes may also be designed to keep the chair stable on the slide.

Figure 5A:
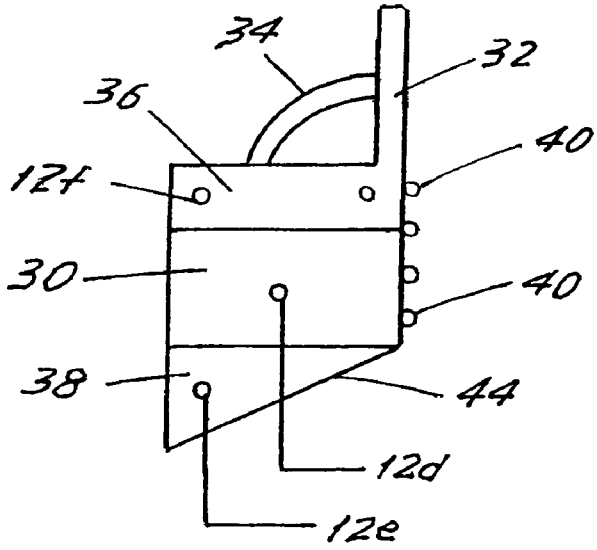
FIGS. 5A and 5B show details of a sliding chair.
Figure 5B:
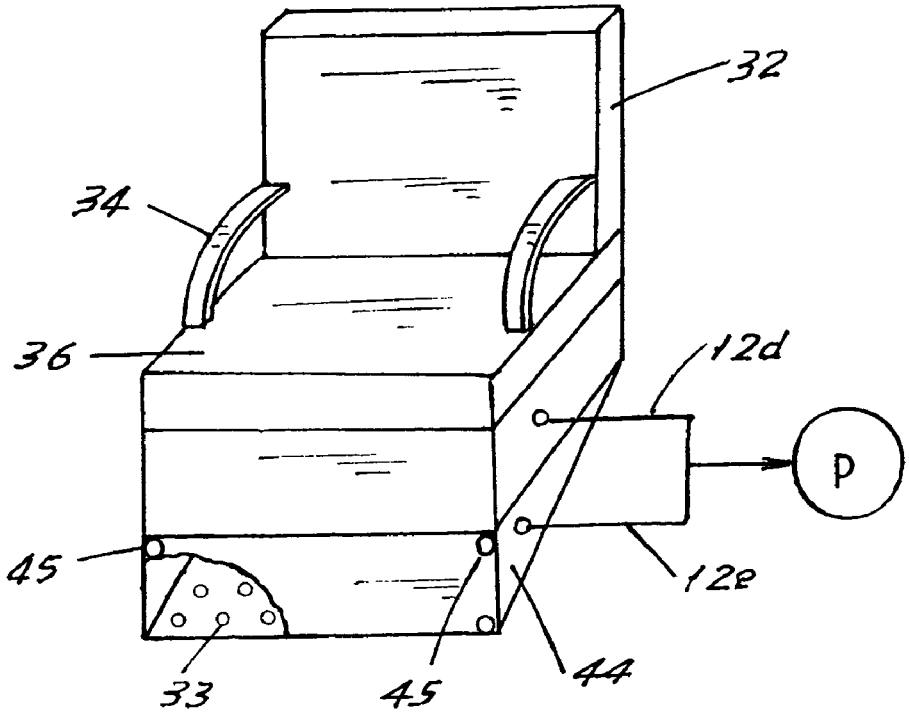
Figure 5C:
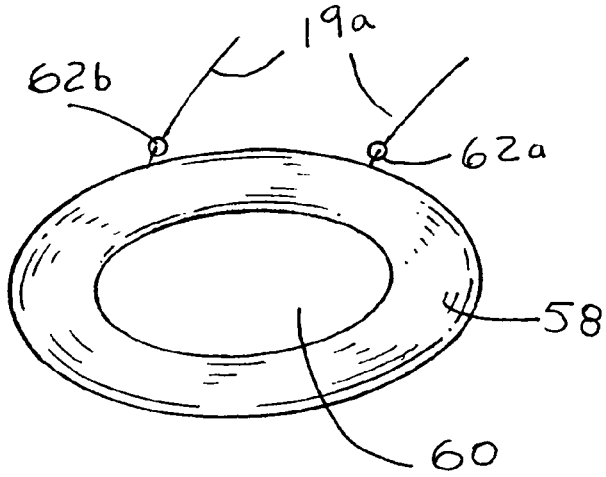
FIG. 5C shows a sliding cushion.

The seat 18 may be formed as an inflatable seat 30 (FIG. 5) with an (inflatable) body 32, harness 34, and arm rest 36. The (inflatable) bottom portion 38 is wedge shaped and has a sliding surface 44 angled to approximate the pitch of the steps. The sliding surface can be made of a solid board, e.g., wood, metal, plastic, and have perforations 33. When the board 44 is perforated, the chamber 38 remains connected to the pump line to blow air out to reduce sliding friction. The chair 18 may be dragged over any floor beyond the slide, to get an invalid to a bedroom, a bathroom or the like, preferably by flattening the wedge 38. The slide may define channels at its sidewalls in which the bottom portion 38 of the chair is wedged, to solidly hold the chair and prevent its tipping or falling off the slide surface Alternatively, the chair may be a relatively flat cushion 58 with a seat 60 and a housing with hooks 62*a*, 62*b* by which it is attachable to the ropes 19*a* of the winch mechanism 19. As another alternative, the person may don a separately provided body harness having a back attachable to the rope of the winching mechanism 19 so as to pull up or allow controlled down sliding of the person, without using a sliding chair or cushion. The instant inventors perceive the means—whether a chair, a cushion or a harness—to be interchangeable.

To proceed down the slide, a person merely needs to sit in the seat 18 and don the harness 34 so that the person does not fall out of the seat. If the pump 19 is equipped with a remote control as discussed previously, it is not even necessary to have the slide inflated prior to use by the person. Once seated in the seat 18, the pump can be activated to inflate the slide. Once inflated, the seat can be lowered down the slide by a handheld pulley with an appropriate mechanical advantage and/or via the winch mechanism 19. The bottom of the seat 18 can be sloped so that the seat remains horizontal while sliding down the slide. The chair may be configured so that the person resting on it faces down or, alternatively, sideways.

To start the sliding chair down the inclined surface, the frail invalid or incapacitated person may sit down on the chair or cushion at the location of the first step and then operate the winching mechanism to which the chair is fastened. Alternatively, the inflatable slide surface may start at a top landing, where the slide has a horizontal section and the person may sit down on the chair at that horizontal level. Operating one of the controls will inflate the distal end of the landing to, in effect, urge the chair forward to allow the person to start sliding down by gravity, held back by the winch. Alternatively, the bottom chamber 38 is tethered to the pump 16 and the chamber 38 is inflated only when the chair is positioned over the steps. Although the invention shows the chair with the person facing in a direction of travel, the person may be sitting at the 90° position, able to see up the stairs by facing left or down the steps by facing right.

The body 4 of the slide 3 may be constructed such that the height of the sliding surface above the steps is on the order of 2-3 feet, i.e., sitting height, so that a person may sit on a relatively flat cushion with the feet dangling above and not quite reaching the level of the steps.

A major advantage of the present invention is the low weight and size of the deflated overall system. Deflating the sliding body reduces its weight and volume so considerably, that it allows an elderly companion of a person or the elderly person himself or herself to both deploy the slide and to disassemble and store it away. The system can be taken with a person who needs to use it at someone else's home and easily deployed there. The slide can also be deployed on stairs at public buildings, etc.

Moreover, the system of the present invention can also be utilized in homes for ferrying heavy objects up and down a staircase, and for this purpose, instead of a sliding chair, a sliding container is provided in which heavy objects can be placed and the objects themselves tied to the winching rope and so conveyed up or down stairs. Persons in the moving business may quickly deploy it to slide or lift refrigerators, washing machines, etc. over stairs as noted.

Figure 6:
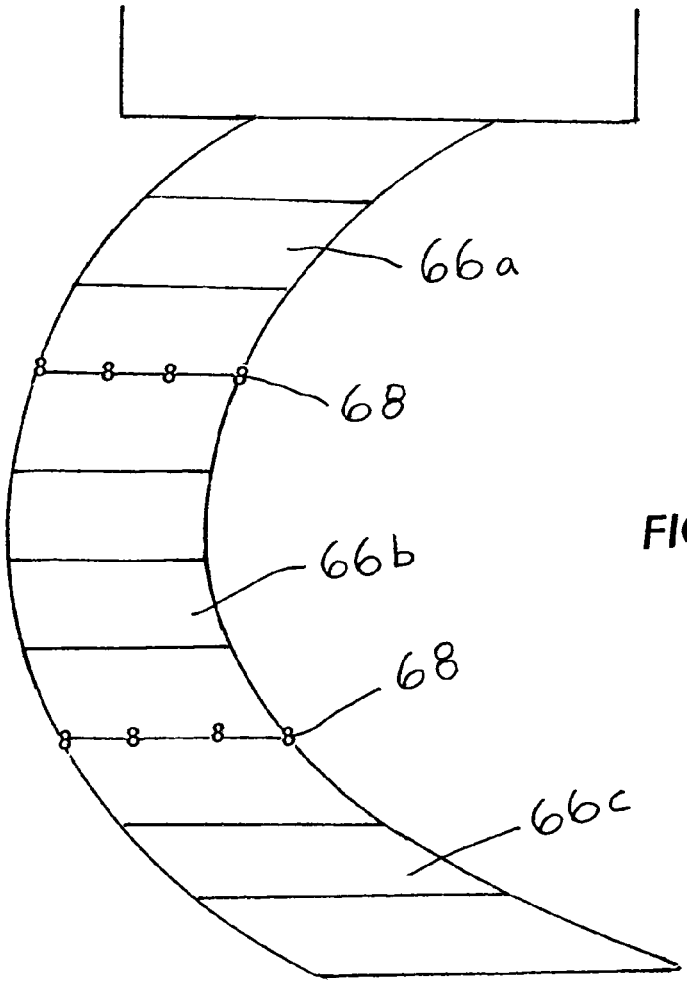
FIG. 6 is a perspective of a multiple section inflatable slide mounted on a curving staircase.

The system of the present invention can be provided in a form where the step shaped pieces are not inflated (or not provided) and the slide is disposed over flat surfaces to allow horizontal sliding of heavy objects therealong. The sliding system of the present invention can be provided in several attachable sections 66*a*, 66*b* and 66*c* attached by straps 68 (FIG. 6), so that it can accommodate different staircase lengths or distances over which heavy objects or people must be ferried.

The sections can be attached to each other by strings 68, ropes, snaps, adhesives or any known means. Moreover, the sections need not be longitudinally straight, and may be somewhat accurate so several sections can be joined to fit an accurate staircase.

A main aspect of the present invention is that the material of the slide be sturdy enough not to easily rupture and, at the same time, very light. Moreover, either the chair or the container in which objects can be placed have bottoms that similarly have very low friction coefficients, so there is little friction between the two sliding surfaces, whereas either a person or a heavy object can be easily slid or pulled down or pulled up or slid down along the sliding surface.

Although the present invention has been described in relation to particular embodiments thereof, many other variations and modifications and other uses will become apparent to those skilled in the art. It is preferred, therefore, that the present invention be limited not by the specific disclosure herein.

What is claimed is:

1. A stair slide comprising:

a longitudinally extending and inflatable slide body having an upper inflatable body which defines a sliding surface;

a mounting device attached to an upper end of the slide body for securing the slide body at a top of a stairway; and a seat for sliding on the upper surface of the body; and a winch attached to the seat for lowering and raising the seat along the upper surface of the body.

2. The stair slide of claim 1, wherein:

the longitudinally extending and inflatable slide body has an upper inflatable body which defines a sliding surface and a lower body below the sliding surface, the lower inflatable body being located on a plurality of inflatable expansion chambers, which expansion chambers, when inflated, have at least a portion thereof which conforms to steps of a stairway and which support the sliding surface thereabove; and a mounting device attached to an upper end of the slide body for securing the slide body at a top of a stairway.

3. The stair slide of claim 1, further comprising a lower end of the body opposite the upper end that is formed as a flat landing area.

4. The stair slide as in claim 3 wherein an inflatable wall surrounds the flat landing area.

5. The stair slide as in claim 4, wherein the body forms a single inflatable chamber.

6. The stair slide as in claim 1, and further comprising handles mounted on the body to facilitate climbing up the body.

7. The stair slide as in claim 1, and further comprising a pump connectable to the body and operative to inflate the body.

8. The stair slide as in claim 7, wherein the body has at least one air inlet, the pump being connected to the inlet by a conduit.

9. The stair slide as in claim 8, wherein the body has a plurality of air inlets connected to the pump by the conduit.

10. The stair slide as in claim 9, and further comprising an air pressure sensor provided so as to sense air pressure in the body, the sensor putting out a start signal to actuate the pump when the air pressure is below a predetermined value, and a stop signal to stop the pump when the air pressure reaches a predetermined value.

11. The stair slide as in claim 7, wherein a plurality of pin-holes are provided in the upper surface of the body so as to create an air cushion on the upper surface.

12. The stair slide as in claim 7, and further comprising a remote control for actuating the pump.

13. The stair slide as in claim 1, wherein the mounting device includes an elongate rigid member that extends laterally beyond the body so as to be engageable behind a fixed structure.

14. The stair slide as in claim 1, wherein the body is formed by a plurality of compartments that are individually inflatable.

15. The stair slide as in claim 1, wherein the body has at least one air outlet valve.

16. The stair slide as in claim 1, wherein the lower body in a region of at least one of the steps has an additional inflatable chamber to compensate for variances of step heights of the stairway.

17. The stair slide as in claim 1, wherein the body is formed so that when deflated, the body can be folded or rolled into a relatively compact shape.

18. The stair slide as in claim 1, wherein the seat has a slanted bottom surface so that a sitting area of the seat is horizontal when on the upper surface of the body.

19. The stair slide as in claim 1, wherein the body comprises several, connectable sections.

* * * * *